US007850146B2

(12) United States Patent
Kempf

(10) Patent No.: US 7,850,146 B2
(45) Date of Patent: Dec. 14, 2010

(54) LINESET WINCH WITH BRAKING PARTS

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 12/483,210

(22) Filed: Jun. 11, 2009

(65) Prior Publication Data

US 2009/0309084 A1 Dec. 17, 2009

Related U.S. Application Data

(60) Provisional application No. 61/061,403, filed on Jun. 13, 2008.

(51) Int. Cl.
*B66D 1/00* (2006.01)

(52) U.S. Cl. ..... 254/333; 254/342; 254/383; 242/615.3

(58) Field of Classification Search ..... 254/333, 254/383, 342; 242/397, 615.3, 615.4, 615.2
See application file for complete search history.

(56) References Cited

U.S. PATENT DOCUMENTS

| | | | | |
|---|---|---|---|---|
| 3,150,861 | A * | 9/1964 | Ahlbin | 254/383 |
| 4,348,125 | A * | 9/1982 | Fujiwara et al. | 400/645.1 |
| 4,974,814 | A * | 12/1990 | Cundy | 254/345 |
| 5,018,708 | A * | 5/1991 | Shaffer | 254/266 |
| 5,141,206 | A * | 8/1992 | Shaffer | 254/266 |
| 5,988,596 | A * | 11/1999 | Mitchell et al. | 254/271 |
| 6,966,544 | B2 * | 11/2005 | McCormick et al. | 254/342 |
| 7,104,492 | B1 * | 9/2006 | Massell et al. | 242/397 |
| 7,185,881 | B2 * | 3/2007 | Drarvik et al. | 254/267 |
| 7,478,795 | B2 * | 1/2009 | Grapes et al. | 254/333 |

* cited by examiner

*Primary Examiner*—Emmanuel M Marcelo
(74) *Attorney, Agent, or Firm*—Law Office of Scott C. Harris, Inc.

(57) ABSTRACT

A winch which can operate with an external brake, or the external brake can be removed to operate with an internal brake. The winch has a cable drum that rotates to get cable on and off the drum. Two eccentric cams are rotated to always keep a soft plastic part pressed against the drum.

16 Claims, 7 Drawing Sheets

LINESET WINCH WITH BRAKING PARTS

This application claims priority from provisional application No. 61/061,403, filed Jun. 13, 2008, the entire contents of which are herewith incorporated by reference.

BACKGROUND

Winches can be used to move various objects and scenery, especially in a stage environment.

SUMMARY

The present application describes a special winch with cable holding parts and a brake attachment.

DETAILED DESCRIPTION

Figure 1A:
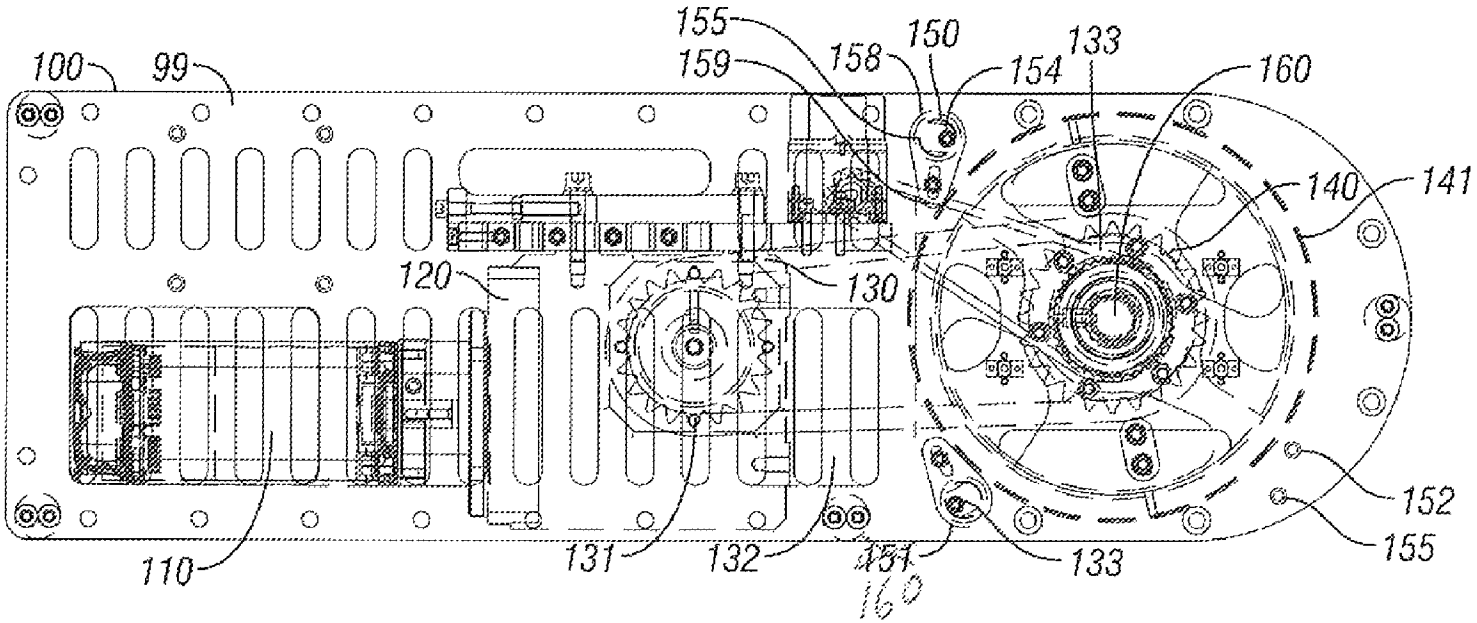
FIGS. 1A and 1B illustrate sections of the winch.
Figure 1B:
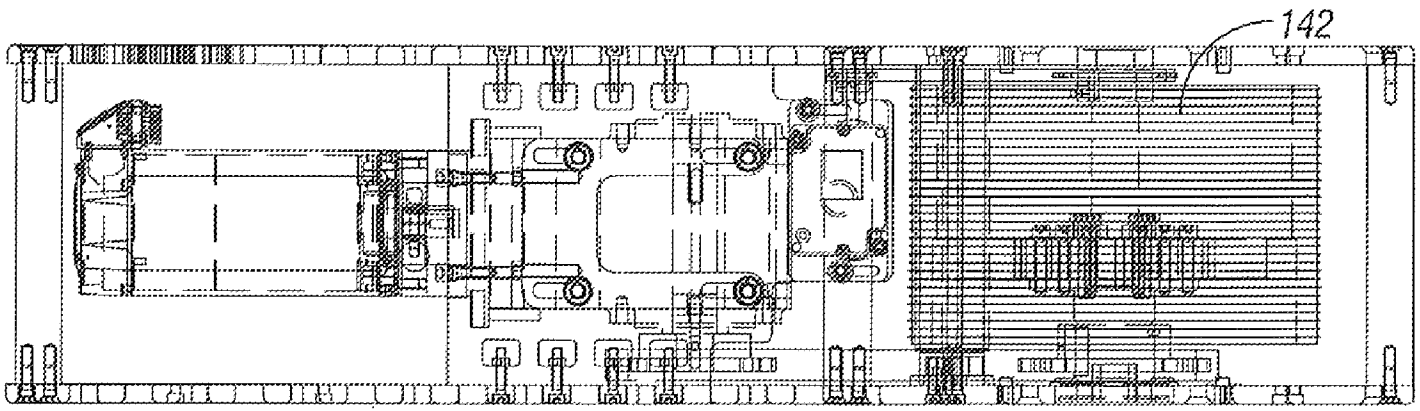
Figure 2:
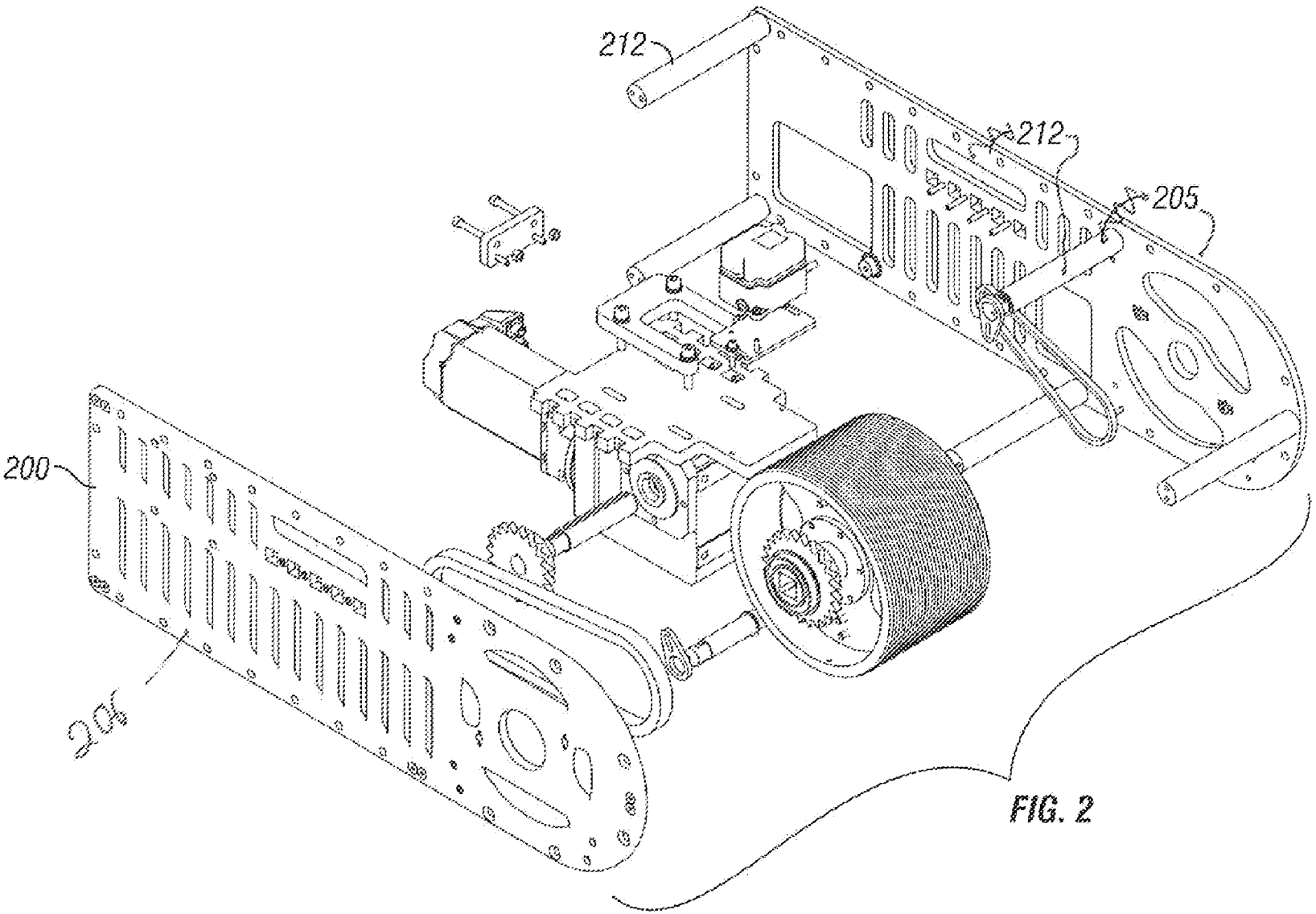
FIG. 2 illustrates an exploded view of the winch.

A basic diagram of the winch of an embodiment is shown in FIGS. 1A, 1B and FIG. 2.

FIG. 1A shows a "front" view of the winch 100, showing the parts seen through the external housing 99. FIG. 1B shows a top view of the winch, and FIG. 2 shows an exploded view of the same winch, showing all the parts.

The winch includes an electric motor 110 which rotates via a gearbox 120 to run a chain drive assembly 130. The chain drive assembly includes a sprocket 131 driving a chain 132. The chain connects to a corresponding sprocket 133 on the wire drum 140. The wire drum 140 rotates based on force applied by the sprocket. The outer surface 141 of the wire drum holds the cable thereon. The cable 142 is shown wound on the drum, for example in FIG. 1B. The cable is wound and unwound based on the direction of motion of the cable.

The inventors recognize that it is extremely important to maintain the cable tightly pressed against the drum. If the cable on the drum is allowed to get loose on the drum, it may get fouled and tangled. A fouled and/or tangled cable would make the winch unusable.

In an embodiment, a number of eccentrically mounted cams 150 151, and 152 are mounted with cylinders that form pressing surfaces that are pressed against the outer surface 141 of the drum. These pressing surfaces are held in a way that makes them stay tight against the drum surface at all "fill levels" of the drum surface, that is for all amounts of cable that the cable is filled on the drum surface. These cams are mounted to have a rotate axis portion that is offset relative to the rest of the cam. Rotation of the axis, e.g., by a rotation that is geared to the rotation of the cable drum, causes that pressing surface to press against the outer surface of the drum. The offset configuration of the pivot point ensures that the drum is pressed in all fill levels.

FIG. 1A shows the cam 150, with an inner pivot area 154. Rotation pivot 155 is off center within the offset from the basic rotation of the cam itself. The pivot 155 is caused to rotate as the drum rotates, thus pressing the outer surface of the cam against the outer surface of the drum. In the configuration of FIG. 1A, the pivot 155 rotates counterclockwise to press the surface 159 against the cable. The cam in essence self adjusts to the size of the materials on the drum. As the drum moves, cable is wound on or off of the drum. The rotation also causes the cams to rotate tighter against the drum, thereby holding the cable more tightly against the drum in this way.

Analogously, the cam 151 has a pivot 160 that rotates counterclockwise to press against the drum.

Each pair of cams holds a roller such as 211 between the cam pairs. The offset pivot of the rotation, as discussed above, is offset relative to the center of the roller.

FIG. 2 shows an exploded view, showing many of the parts described above. The drum also includes a rectangular, e.g., square, inner cross-section surface 160. This surface 160 is adapted to mount an externally provided brake device.

The eccentric cam rollers 150 have an outer surface 158 which is formed of a soft plastic such as Delran that rubs against the steel cable rolled on the roller. The eccentric spinning of the cam causes the cam to continually press against the steel cable with a similar amount of force, thereby maintaining pressure against the cable.

FIG. 2 also illustrates how the device has housing portions 205, 206 which are held apart by spacer rods such as 212. The housing holds the motor 110 which connects directly to the gearbox 120.

Figure 3A:
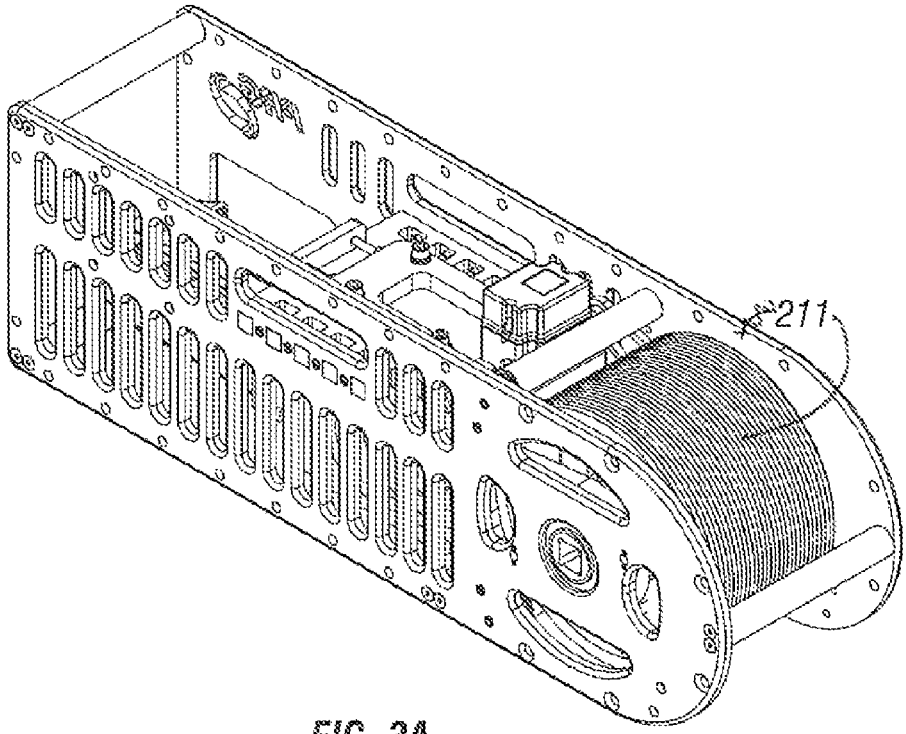
FIGS. 3A-3D illustrate the winch being configured in different ways.

In operation, this device can be operated in a number of different configurations. FIG. 3A illustrates the standard configuration, in which the winch is essentially vertical, and the drum 140 pays in and out the cable. The perspective view of FIG. 3A shows the roller 211 and how that roller is pressed against the outer surface of the drum by rotation of the eccentric cams. The eccentric cams are rotated to press the surface of the roller 211 against the outside surface of the drum.

Figure 3B:
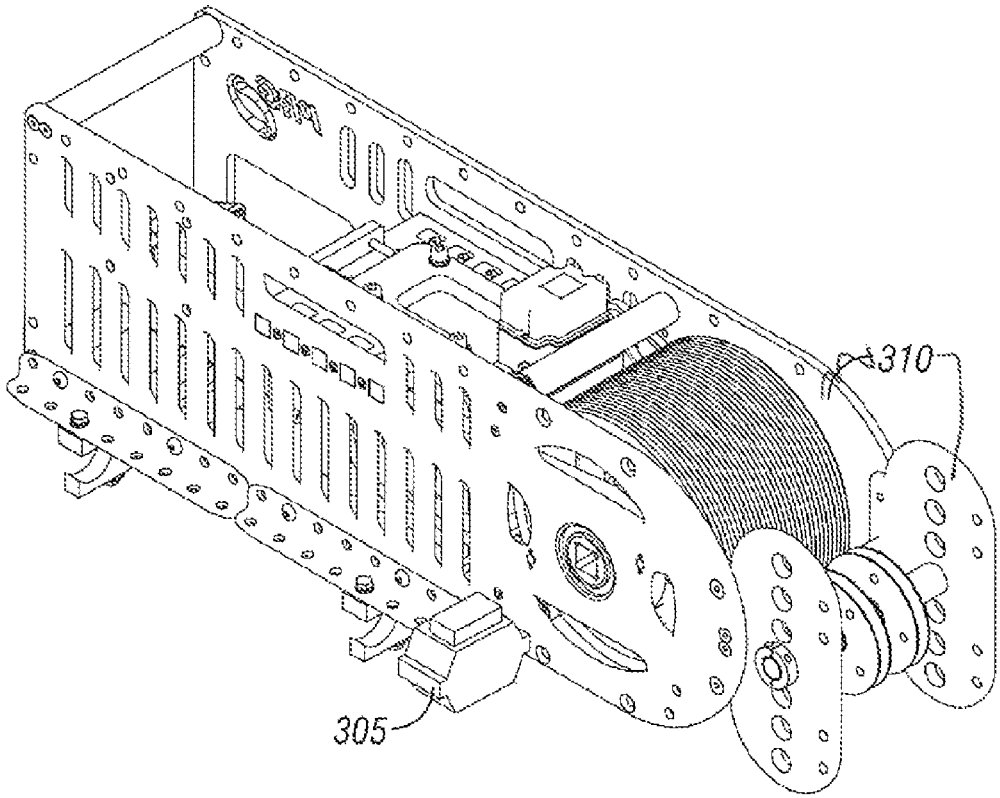
Figure 3D:
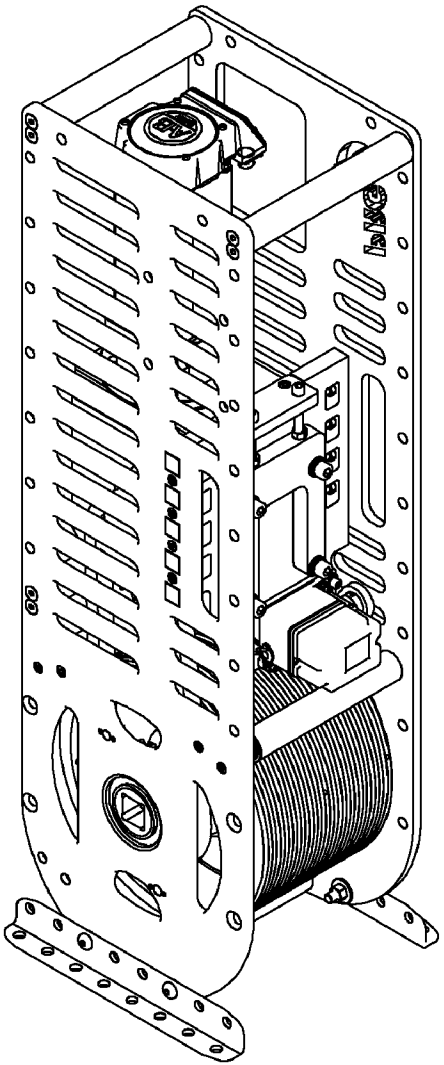

FIG. 3B illustrates how the winch can be mounted on a truss from its bottom surface using clamps 305, and how outriggers such as 310 can be attached to the cam to adjust its operation. The winch can also be used in the straight up position, both with the drum down as in FIG. 3C and the drum up as in FIG. 3B.

Figure 4:
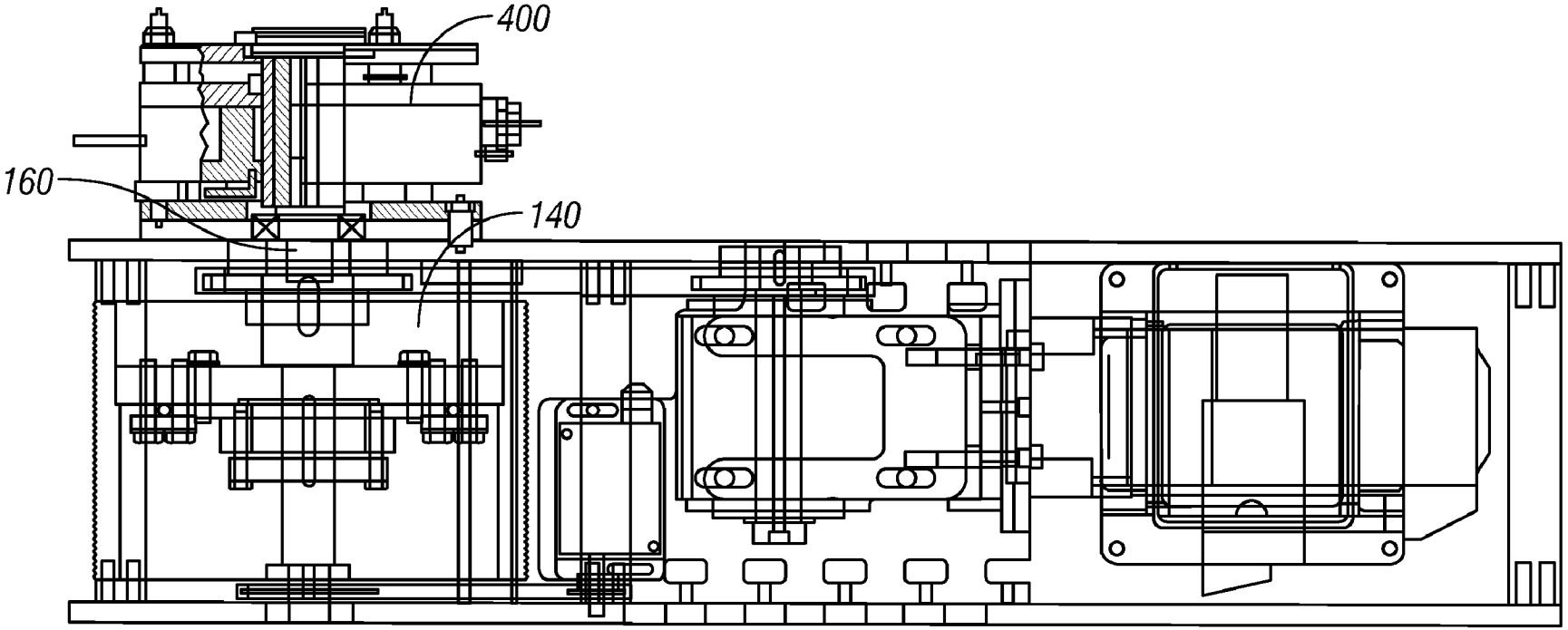
FIG. 4 shows a winch-and-brake combination.
Figure 5A:
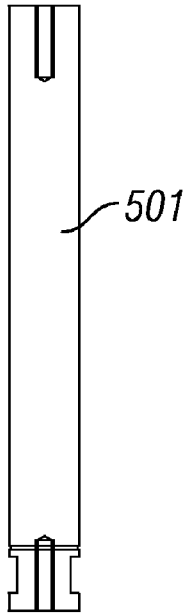
FIG. 5A-5D show the collar configuration that presses against the outside of the drum.
Figure 5B:
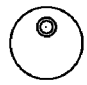
Figure 5C:
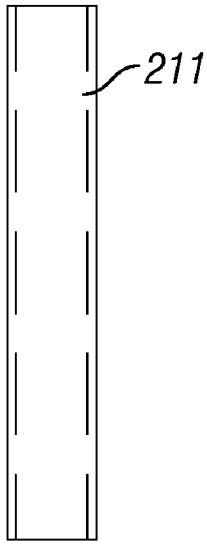
Figure 5D:
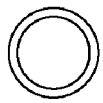

According to an embodiment, the drum 140 has a rectangular hole 160 which mounts with a corresponding motor brake shown as 400 in FIG. 4. The motor brake can be an external brake, placed on the winch for additional safety precautions. By using an external electronically controlled brake, additional braking capability beyond the relatively limited motor braking allowed by the motor 120 can be used.

This allows using the winch in two different configurations. In a counterweight configuration, the load carried by the winch is wholly counterweighted. The lifting is less dangerous since there is less force on the lifting. If some malfunction occurs in the winch, the counterweight causes the operation to simply stop.

However, in the dead hauling configuration, the winch hauls the item up or down without any counterweight. A configuration is provided which allows using an external brake 400, which can be a mechanical braking device.

FIG. 5 illustrates further detail of the eccentric cam, and its outer shaft 211. A keeper assembly forms an outer shaft 211 which has its outer surface formed of Delrin plastic. The keeper roller shown in FIGS. 5A and 5B fits inside the inner surface of the outer rod 211. The keeper shaft 501 may be a steel rod, with an eccentric mounted structure shown as the end view in FIG. 5B. The keeper assembly 211 presses against the outer surface of this device, rotating along its axis, but with the outer surface of the roller pressed against the drum. This roller, however, is retained so it acts as its own bearing, with the keeper assembly 211 rotating on the outside of keeper shaft 501.

Figure 6A:
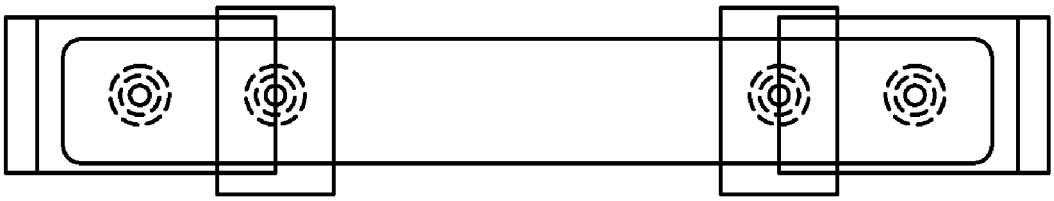
FIGS. 6A-6B show a hanging configuration.
Figure 6B:
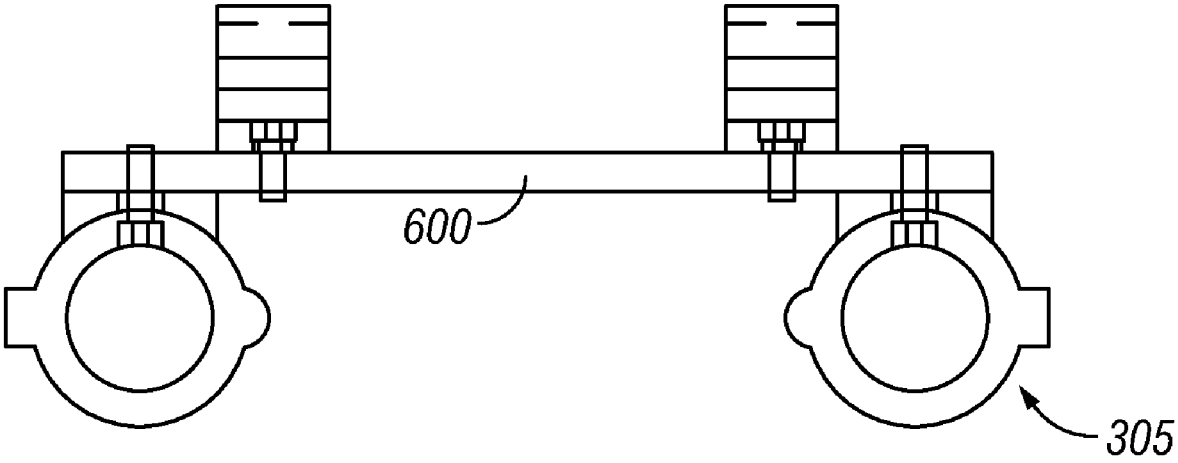

The details of the mounting by clamps as shown in FIG. 3B, is shown in further detail in FIGS. 6A and 6B. Both illustrate how the clamps such as 305 can be mounted to the mounting surface 600. FIG. 6A illustrates a top view of this same structure.

The winch may be sized in different ways.

A first sizing is as described herein, called a "lineset" or Raptor™ winch. The lineset winch is preferably 37" in length, 9 inches Width: 9" (15" with optional secondary brake). Depth: 12". Weight: 150 lbs without secondary brake (175 lbs with brake)

Operating parameter targets for the lineset winch are as follows:

Max load speed: 6.1 fps

Max line pull: 230 lbs

Max load travel: 71'

Examples of Winch Applications

Driving counterweight assist line sets

Driving traveler tracks

Driving lighter duty deck tracks

Dead hauling small scenic units or soft goods with secondary brake mounted

Winch Mounting

The lineset winch can mount above/below/beside a surface with the modular steel angle brackets.

The lineset winch can mount above/below/beside a surface or truss with 32 mm pipe clamps attached to the integral 1¼" handles in the winch frame.

Winch Shipping and Handling

When not permanently mounted to a truss, up to 5 winches can be strapped/shrink wrapped together on a standard wood pallet.

Winch Accessories

The lineset winch has accessory steel mounting brackets that can be welded to venue structure and discarded if necessary.

The lineset winch can include accessory 32 mm pipe clamp brackets for mounting with the 1.25" knurled handles. A custom absolute encoder mount can be used.

Figure 3C:
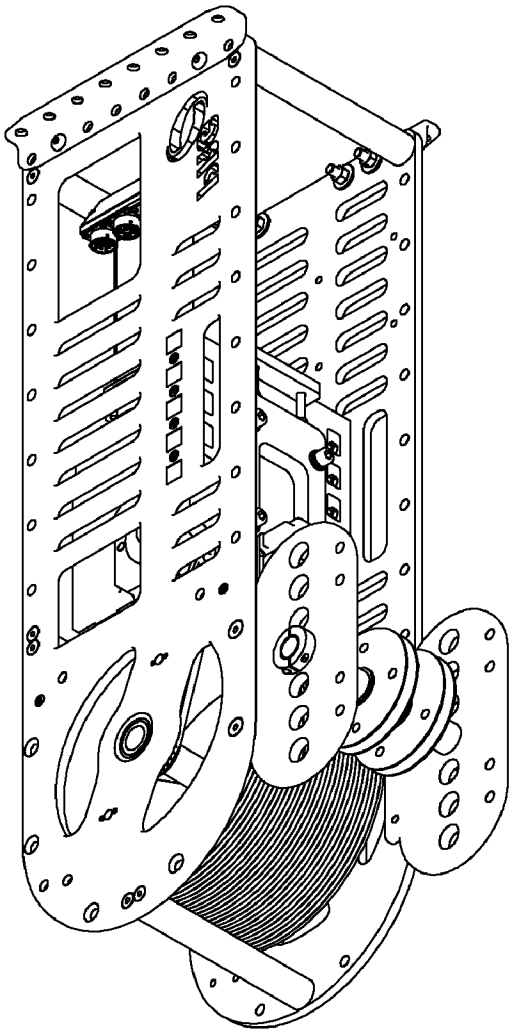

Accessory outrigger sheaves, which can also take steel mounting brackets for drum down/motor vertical applications, can be used as shown in FIGS. 3B and 3C.

The Lineset Winch Has an Accessory Secondary Brake That Bolts to the Winch Cheek Plate and Engages With a Square Shaft. Rigging Access and Operation Cable entrance holes in first full groove both sides of drum.

Cable clamps on drum center plate.

Two openings in one cheek plate allow access to cable clamps, plus two smaller holes in the opposite cheek plate allow for finger/tool access to push cables across the surface.

For rigging individual winches prior to the control system arrival at the venue, a 120 VAC control box can be used to release the dual brakes and spin the drum at half speed max in order to rig the winch. A 120 VAC brake release only can also be used, without a drive. There are preferably no pull pins for this winch.

Maintenance Access

The lineset winch can be disassembled in the field with an Allen key set and components swapped out.

The motor, limit box, secondary brake, gearbox, and IJ box may all be exchanged without de-rigging the winch drum.

Electrical Access

PRG motor/brake cable connects to IJ box panel mount on the back of winch.

PRG universal feedback cable connects to IJ box panel mount on the back of winch.

Limit box and motor are hard wired to fittings on the side of the IJ box. The secondary brake is a plug in.

Disconnect switch in IJ box is located on the back of the winch.

IJ box is fastened between the cheek plates with four small screws. By removing the screws and releasing the tails, the entire electrical assembly can be removed from the winch.

List of purchased mechanical parts (fastening hardware not included) can include ● Motor—Allen Bradley MPL-A430P, ● Gearbox—Stober k202 28:1, ●Gearbox sprocket—50BS20 ⅞" bore KWSS, ● Drum sprocket—Martin 50BS24 2" bore sweated, ● Drum hub QD-QD-SK 1¼" ● Drum hub—Martin 60SK30 (machine shop modified), ●Optional secondary brake—Mayr Roba-stop 250, ● Drum bearing drive side—50 mm SKF 6010-2RS1-NR, ● Drum bearing feedback side—1" General 23216-88, ● Limit box—TER MF2C 100:1, ●Limit box driver sprocket—Martin 25B40 1" bore KWSS, ● Limit box Driven sprocket—Martin 25B15¼" bore Dual SS, ● Mounting cheeseboros—Doughty T58800 32 mm List of CNC Cut and Then Machined Aluminum Parts ½" cheek plate right ½" cheek plate left ¾" gearbox plate ¼" limit mount plate ½" gearbox puller tab 1" drum center plate ⅜" cable clamps (no machining at WC)

¼" keeper cam

⅝" walking sheave blanks

⅜" outrigger plates

List of CNC cut and Then Machined Steel Parts

½" Cheeseboro mount

¾" gearbox tensioner

List of Machined Only Parts 2.125" od stainless steel drum shaft 1.875" od stainless steel gearbox shaft 1.25" od knurled aluminum handles 1" od stainless steel keeper shafts 1.5" od black delrin keeper rollers 1.25" od stainless steel outrigger shafts Bronze walking sheave bushings Drum hub (modified purchased part)

List of Automation Shop Parts

Sheet metal IJ box

Local hard wired tails to motor, limit box, and plugged secondary brake

List of Subcontracted Parts or Services

Powder coating of aluminum/steel parts

Target Winch Speed Calculation 4300 rpm motor speed divided by 28:1 gearbox equals 154 rpm gearbox out speed passing through a 20:24 chain stage for a drum speed of 128 rpm multiplied by a 34.2" drum circumference per revolution equals 4378 inches per minute divided by 12" inches per foot and 60 second per minute equals a line speed of roughly 6.1 feet per second.

Target Winch Line Pull Calculation

A 40 in-lbs motor into a 28:1 gearbox produces 1120 in-lbs of torque multiplied by 94% gearbox efficiency equals 1053 in-lbs into a 20:24 chain stage that is 98% efficient produces 1238 in-lbs at the drum shaft. The 1238 in-lbs divided by a drum radius of 5.44" yields 228 lbs of line pull.

Target Winch Travel Calculation

A 10.88" diameter drum 6.88" wide with 0.219" lead for 3/16" cable has roughly 31 complete wraps minus 6 safety wraps equals 25 active wraps multiplied by 34.2 inches per wrap equals 854 inches divided by 12 inches per foot equals 71' max load travel.

An accessory brake can also be used with the lineset winch.

When made in a smaller size, this may form a "baby winch" or Bantam™ winch, which has the following characteristics. The baby winch can be in the size of 2 shoe boxes. An embodiment arranges the parts in a special way to reduce the size.

This is a super compact utility winch designed to perform high speed, low line-pull, non life-safety, effects and especially to fit into spaces where no other cable winches can fit.

The baby winch can be of Length: 31" or 37" with addition of electrics IJ box, ● Width: 6.375", Depth: 9", Weight: 77 lbs or 85 lbs with addition of electrics IJ box.

Operating Parameter Targets

Max load speed: 5.6 fps

Max load line-pull: 100 lbs

Max load travel: 55' plus 6 safety wraps

Examples of winch applications include:

Driving lightweight pallets laterally inside decks, turntables, or larger scenic units.

Driving lightweight travelers under truss or inside larger scenic units.

Driving lightweight tabs from trusses, grids, or inside larger scenic units.

Dead hauling very lightweight set electric fixtures, props, or soft goods.

Winch mounting can be carried out in many ways:

Horizontal above/below/beside surface with stock angle brackets.

Vertical (drum up or down) above/below/beside surface with stock angle brackets.

Vertical (drum up or down) above/below/beside truss or pipes with 32 mm pipe clamps.

Horizontal or vertical in any orientation through the use of additional custom mounts.

Ideally the IJ box should be strong enough to connect the suspended winch to structure. The current curved box design, though attractive is missing the second hole needed for this mounting option.

Winch Shipping and Handling

When not built into a larger scenic unit or truss assembly, the baby winch can be boxed for transport like an audio or electric component. Multiple baby winches can travel in custom road boxes to be designed at a later date.

The 1.25" OD handles on the winch are strong enough to be used as carry handles and lifting points.

Winch Accessories

The Baby winch has steel angle mounts that can bolt to twelve locations on the cheek plates for a variety of mounting positions listed above. The mounts are made of steel and can be welded to structures in the field and then disposed of if necessary.

List of Purchased Mechanical Parts (Fastening Hardware Not Included)

Motor—Allen Bradley MPL-A320P

Gearbox—Alpha VDH 050 28:1

Gearbox sprocket—Martin 40BS22

Drum sprocket—Martin 40BS22 (machined after purchase)

Drum hub—Martin 40SH27 (machined after purchase)

Drum bearings—General S23216-88

Limit box—TER MF2C 50:1

Limit box driver—Martin 30XL037

Limit box driven—Martin 22XL037

Limit box belt—Gates 150XL037

List of CNC Cut and Then Machined Aluminum Parts

⅜" Limit plate

¼" Limit tab

¼" Keeper cans

¼" Bearings shims

⅜" Cable keepers (no machining)

1" Drum center plate

½" Pusher plate

½" Gearbox plates

⅜" Cheek plates

List of Machined Only Parts

Winch drum

Drum hub (modified purchased part)

Mounting feet 1.25" stainless steel Drum shaft 1.25" stainless steel Gearbox shaft 1.25" knurled aluminum rod handles 1.25" Delrin Keeper rollers 1" stainless steel Keeper shafts List of Automation Shop Parts Sheet metal IJ box Local hard wired tails to motor and limit box Target Winch Speed Calculation 4000 rpm motor speed divided by 28:1 gearbox equals 143 rpm gearbox out speed passing through a 22:22 chain stage for a drum speed of 143 rpm multiplied by a 28" drum circumference per revolution equals 4000 inches per minute divided by 12" inches per foot and 60 second per minute equals a line speed of roughly 5.6 feet per second.

Target Winch Line Pull Calculation

A 21 inlbs motor into a 28:1 gearbox produces 644 inlbs of torque multiplied by 83% gearbox efficiency equals 534 inlbs into a 22:22 chain stage that is 95% efficient produces 507 inlbs at the drum shaft divided by a drum radius of 4.44" yields 104 lbs of line pull. Empirical testing with additional sheave friction has produced only 90 to 95 lbs of consistent line pull.

Target Winch Travel Calculation

A 8.88" diameter drum 4.63" wide with 0.156" lead for ⅛" cable has roughly 28 complete wraps minus 4 safety wraps equals 24 active wraps multiplied by 27.9 inches per wrap equals 669 inches divided by 12 inches per foot equals 55' max load travel.

Baby winch suitable for all horizontal loading applications.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes and parts can be used.

What is claimed is:

1. A winch device, comprising:

a cable drum, which rotates in a first direction to wind cable thereon, and rotates in the opposite of said first direction to allow cable to be unwound and removed from the drum;

a power train, which supplies rotational force to said cable drum, to wind and unwind the cable; and at least first and second cable holding cams, and a cable roller held by said first and second holding cams, said cable roller pressed against an outer surface of cable that is wound on said drum, and said cable roller holding the cable on said drum, said first and second cams automatically adjusting to different amounts of cable on said drum to press against said outer surface of said cable on said drum at different fill levels of cable on said drum.

2. A device as in claim 1, wherein said first and second cams have outer surfaces formed of soft plastic.

3. A device as in claim 2, wherein said first and second cams have inner portions which rotate within an outer portion, and wherein an outer surface of said outer portion forms said outer surfaces, and wherein said rotation holds said outer surfaces against said cable on said drum.

4. A device as in claim 1, wherein said cams rotate eccentrically around an axis that is not centered relative to an axis of rotation of said cam.

5. A device as in claim 1, further comprising third and fourth cable holding cams, which are rotated in different directions than said first and second cable holding cams.

6. A device as in claim 1, wherein said powertrain includes an electric motor which rotates and a gearing system which delivers power caused by the rotating of said electric motor to said cams.

7. The device as in claim 1, wherein said drum includes a substantially rectangular slot therein, rigidly coupled to said drum to rotate when said drum rotates.

8. The device as in claim 7, further comprising a braking unit, having a shaft with a rectangular outer shape, said rectangular outer shape fitting into said slot in said drum.

9. A winch device, comprising:

a cable drum, which rotates in a first direction to wind cable thereon, and rotates in the opposite of said first direction to allow cable to be unwound and removed from the drum, and where said drum includes a substantially rectangular slot therein, formed in said drum to rotate when said drum rotates, such that preventing said substantially rectangular slot from rotating prevents said drum from rotating; and a powertrain, which supplies rotational force to said cable drum, to wind and unwind the cable and to rotate said rectangular slot as said cable drum rotates, wherein said powertrain includes a motor brake that brakes a motor without using said slot.

10. A device as in claim 9, further comprising a braking unit, having a shaft with a rectangular outer shape, said rectangular outer shape fitting into said slot in said drum, said braking unit stopping rotation of said drum.

11. A device as in claim 9, further comprising at least first and second cable holding cams, and a cable roller held by said first and second holding cams, said cable roller pressed against an outer surface of cable that is wound on said drum, and said cable roller holding the cable on said drum, said first and second cams automatically adjusting to different amounts of cable on said drum to press against said outer surface of said cable on said drum at different fill levels of cable on said drum.

12. A device as in claim 11, wherein said first and second cams have outer surfaces formed of soft plastic.

13. A device as in claim 12, wherein said first and second cams have inner portions which rotate within an outer portion, and wherein an outer surface of said outer portion forms said outer surfaces, and wherein said rotation holds said outer surfaces against said cable on said drum.

14. A device as in claim 11, wherein said cams rotate eccentrically around an axis that is not centered relative to an axis of rotation of said cam.

15. A device as in claim 11, further comprising third and fourth cable holding cams, which are rotated in different directions than said first and second cable holding cams.

16. A device as in claim 11, wherein said powertrain includes an electric motor which rotates and a gearing system which delivers power caused by the rotating of said electric motor to said cams.

* * * * *